US006356208B1

(12) United States Patent
Jeng et al.

(10) Patent No.: US 6,356,208 B1
(45) Date of Patent: Mar. 12, 2002

(54) STRUCTURE FOR A CAR SENSING INFRARED COMMUNICATION DEVICE PLACED OVER A LANE OF A FREEWAY

(75) Inventors: Bor-Shenn Jeng; Chun-Yo Hsu; Hong-Kai Yen; Po-Wen Lu; Hung-Yu Yang; Chun-Jen Chou; Yn-Tarng Jong; Sung-Chu Lai, all of Taoyuan Hsien (TW)

(73) Assignee: ChunghwaTelecom Co., Ltd., Taipei Hsien (TW)

( * ) Notice: Subject to any disclaimer, the term of this patent is extended or adjusted under 35 U.S.C. 154(b) by 0 days.

(21) Appl. No.: 09/848,354

(22) Filed: May 4, 2001

(51) Int. Cl.[7] ..... G08G 1/00

(52) U.S. Cl. ..... 340/928; 235/384; 250/239; 359/144; 359/152

(58) Field of Search ..... 340/928, 905, 340/942, 943, 555, 556, 557, 546.3; 235/384, 380, 382; 359/152, 144, 143; 250/239

(56) References Cited

U.S. PATENT DOCUMENTS

| | | | | | |
|---|---|---|---|---|---|
| 4,680,811 | A | * | 7/1987 | Harper et al. | 455/617 |
| 4,853,524 | A | * | 8/1989 | Yamaguchi et al. | 235/468 |
| 5,440,109 | A | * | 8/1995 | Hering et al. | 235/384 |
| 5,508,917 | A | * | 4/1996 | Siegle et al. | 364/424.02 |
| 5,635,701 | A | * | 6/1997 | Gloton | 235/486 |
| 5,825,007 | A | * | 10/1998 | Jesadanont | 235/384 |
| 5,917,632 | A | * | 6/1999 | Lesesky | 359/152 |

* cited by examiner

*Primary Examiner*—Nina Tong
(74) *Attorney, Agent, or Firm*—Bacon & Thomas

(57) ABSTRACT

A structure for an infrared ray communication device placed over a lane which encloses a wireless infrared communication device and includes an upper cover for an attachment lens, an attachment lens, a rain shield, a light guiding device, a fixed support for an emitting module, a fixed support for a receiving module, a circuit board socket, a trough for a transformer, fixed hooks, and a rain shield. The device is placed over a path of a passing vehicle, and used to receive infrared rays and to proceed with data transmission.

4 Claims, 2 Drawing Sheets

STRUCTURE FOR A CAR SENSING INFRARED COMMUNICATION DEVICE PLACED OVER A LANE OF A FREEWAY

BACKGROUND OF THE INVENTION

1. Field of the Invention

The present invention relates to a structure for a communication device, particularly, a communication device that prevents dust from affecting the transmission quality of the communication device. This device has a novel design structure and uses infrared rays as a communication medium.

2. Description of the Prior Art

The general public has the impression that a freeway is high-speed and convenient for traffic. However, with the living standard rising, every family uses a car as a means of transportation. Because of two day weekends and paying more attention to leisure life, people have more opportunity to use the freeway, and the high-speed freeway becomes a low-speed freeway during weekends as well as during rush hour.

In addition, the problem of tollgates is a source of complaints. Very often there is a long line of cars in front of the tollgates. Because tollgate fees are collected by manpower, using toll collectors, this method usually hinders busy traffic, causing inconvenience. Using toll tickets and collecting the toll later shortens the time for payment. Moreover, manpower has been replaced with coin payment machines in order to deal with the increasing number of cars year by year. However, because the design was flawed, this measure was soon suspended.

In recent years, a method of using infrared rays for sensing cars has been developed to improve the inconvenience described above. However, this method still has disadvantages, such as dust and rain lowering the ability of sensing cars. Cars have to decelerate to a lower threshold speed for accurate sensing, since the receiving ability of the sensor is diminished under these circumstances.

In view of this, the sensing devices described above have many disadvantages and the design needs to be improved.

The present invention solves disadvantages resulting from the payment methods described above. After studying the above situation for a long period, an innovative and improved structure for an infrared communication device placed over a lane was developed.

SUMMARY OF THE INVENTION

The purpose of the present invention is to provide a structure for an infrared ray communication device placed over a lane, which is based on infrared ray communication and is combined with an infrared ray communication device. The structure of the communication device in the present invention, increases the efficiency of signal receiving and emitting used in data transmission.

The second purpose of the present invention is to provide a structure for an infrared ray communication device placed over a lane, which has an attachment lens on an upper cover to prevent dust and miscellaneous particles, and to protect the parts therein. In addition, there is a rain shield to efficiently keep out rain.

One purpose of the present invention is to provide a structure for an infrared ray communication device placed over a lane, which has a light guiding device designed to strengthen the received infrared rays.

Another purpose of the present invention is to provide a structure for an infrared ray communication device placed over a lane, which has a fixed support for an emitting module to extend the effective communication distance of infrared rays.

Another purpose of the present invention is to provide a structure for an infrared ray communication device placed over a lane, whereof a back board with a coating of metal material is provided to prevent electromagnetic noise and to promote stability inside the system.

The structure for an infrared ray communication device placed over a lane, which can achieve the purposes of the invention described above, comprises an attachment lens, a structure for the light guiding device, and a back board with a coating of metal material. The attachment lens serves as a gateway for infrared communication to receive infrared rays and to proceed with information transmission, and isolates dust and miscellaneous particles as well as protects the parts inside the structure. Also, a rain shield is furnished to effectively keep out rain. The shape of the structure of the light guiding device is a quadrilateral trumpet such that the received infrared rays is enhanced and centralized. An infrared ray receiving module is located at the opening of the light guiding device and is responsible for receiving infrared rays. The fixed support for the emitting module has two planes for positioning an emitting module. The included angle of the two planes is calculated based on light properties which determine the included angle such that the effective communication distance of infrared rays is extended. The back board with a coating of metal material provides a grounding shield for the inside circuit board to isolate electromagnetic noise and to promote stability in the functioning of the inside electrical system of the present invention.

BRIEF DESCRIPTION OF THE DRAWINGS

The drawings disclose an illustrative embodiment of the present invention which serves to exemplify various advantages and objects hereof, and are as follows.

Figure 1:
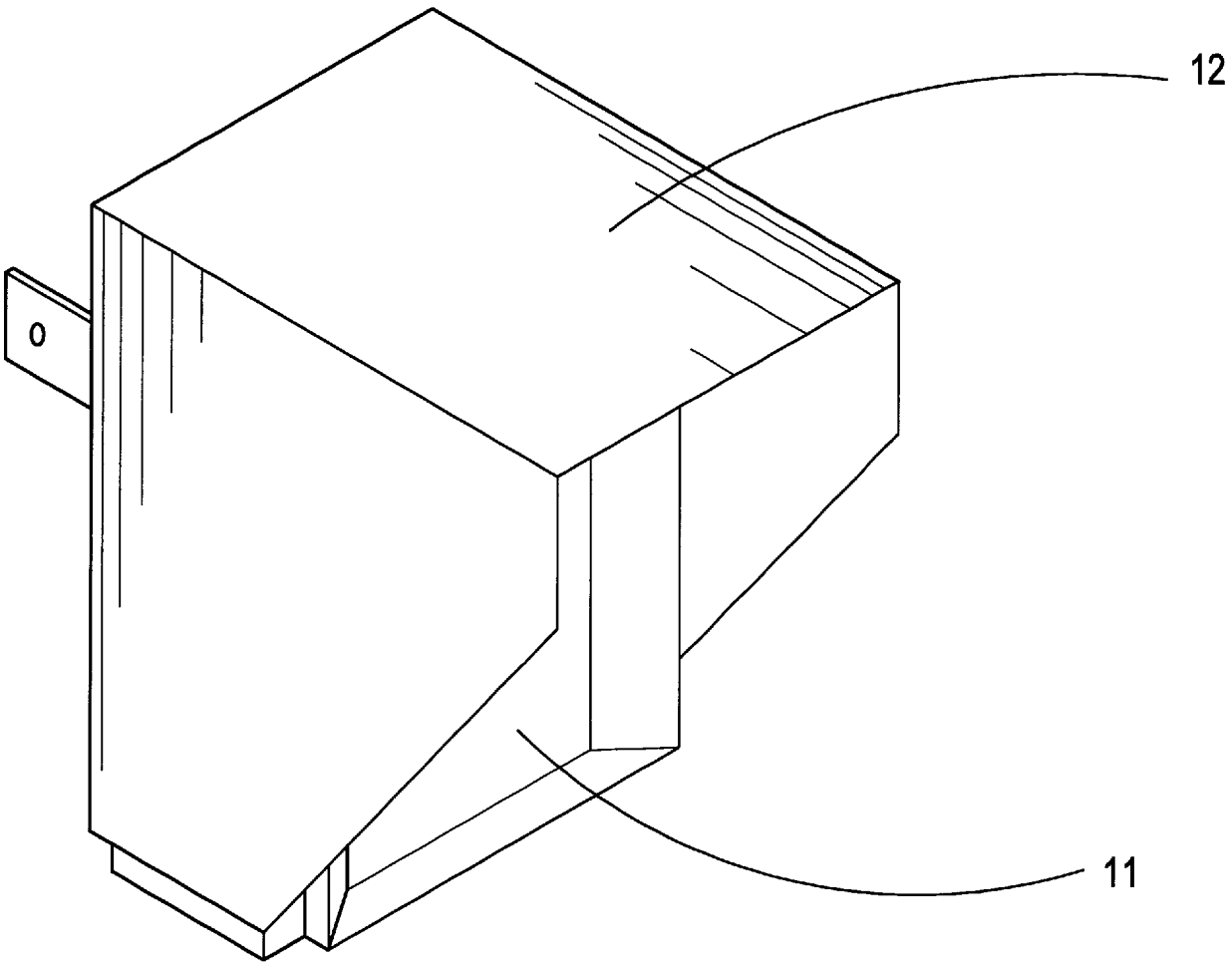
FIG.1 A three-dimensional drawing of the structure for an infrared ray communication device placed over a lane, in accordance with the present invention.

List of Reference Numerals:

11 Attachment lens
12 Rain shield
13 Light guiding device
14 Fixed support for a receiving module
15 Fixed support for an emitting module
16 Back board with a coating of metal material
17 Fixed hook
18 Transformer
19 Circuit board
20 Body
21 Circuit board socket
22 Screw bolt

DETAILED DESCRIPTION OF THE PREFERRED EMBODIMENT

Referring to FIG. 1, the three-dimensional drawing of the structure for an infrared ray communication device placed over a lane in accordance with the present invention comprises an attachment lens 11 which serves as a gateway for infrared ray communication to receive infrared ray signals and to proceed with data transmission, isolates dust and miscellaneous particles and provides protection for parts inside the structure, and a rain shield 12 to effectively keep out the rain.

Figure 2:
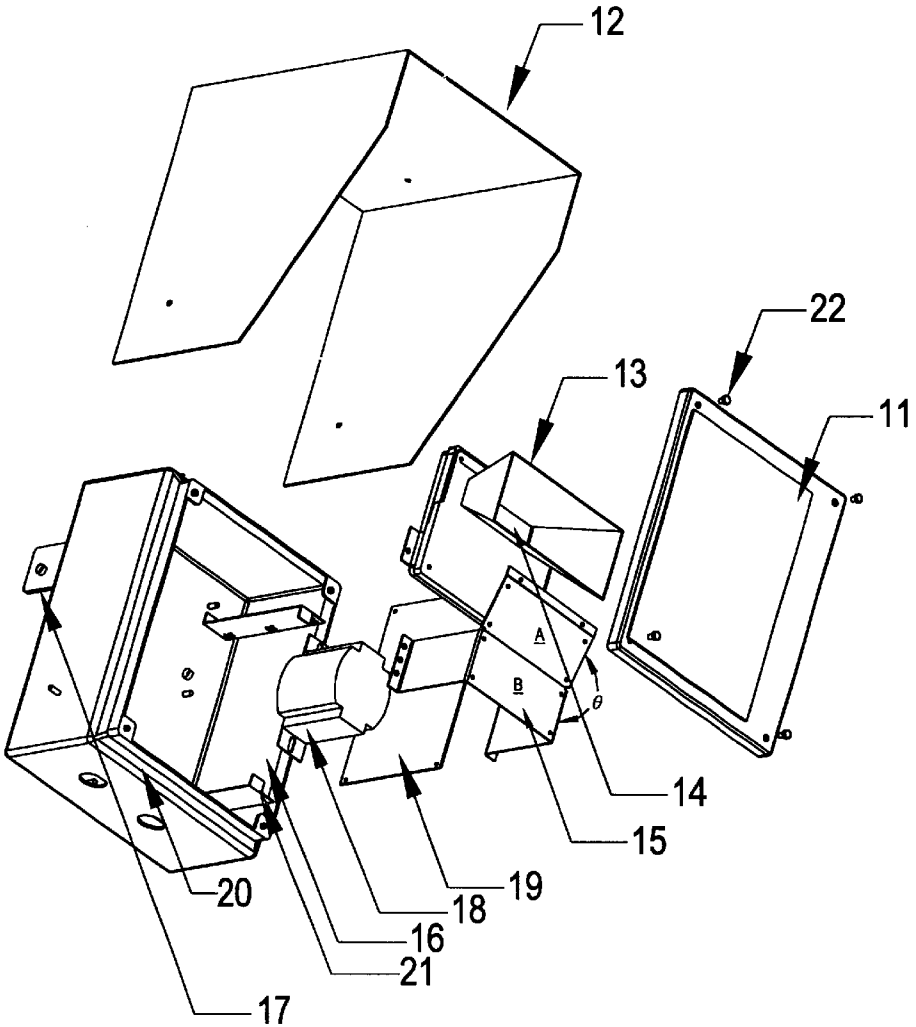
FIG.2 An exploded view of the structure for an infrared ray communication device placed over a lane, in accordance with the present invention.

Referring to FIG.2, which is the exploded view of the present invention, FIG.2 shows an attachment lens 11, an upper cover to the attachment lens, a rain shield 12, a light guiding device 13, a fixed support for an emitting module 15, a fixed support for a receiving module 14, a circuit board 19, a circuit board socket 21, a transformer 18, two fixed hooks 17, screw bolts for the rain shield, and the body of the structure 20.

The light guiding device 13 is designed to have the shape of a quadrilateral trumpet to enhance and centralize the received infrared rays by taking advantage of light properties, and a fixed support for a receiving module, which is designed to sit at the opening of the light guiding device 13 and is responsible for receiving the signal of infrared rays.

The combination of the structure is to make the body serve as an enclosure for all the parts and the structure, to set a circuit board socket 21 at a side of the body for plugging and fixing the circuit board 19, and to set a fixed support for an infrared ray emitting module 15 on the transformer 18. The fixed support has two planes, plane A and plane B, which are used to position an emitting module at an included angle 0 which is calculated by taking advantage of light properties to determine the included angle such that the effective communication distance of the infrared rays is extended. Finally, the attachment lens 11 covers the planes as well as combined and fixed to the body 20, thus, all parts inside the body are completely covered. The rain shield is then set on the lateral of the body and is fixed by screw bolts 22 such that a structure of infrared ray communication device at the top of the lane is assembled.

The interior of the body 20 is a back board 16 which provides the inside circuit board 19 with a metal grounding shield to isolate electromagnetic noise to promote the stability of the electric system inside the device. Fixed hooks 17 are located on the exterior so that the body can be conveniently fixed on another object.

The structure for an infrared ray communication device at the top of a lane provided by the present invention has the following advantages:

1. An attachment lens serves as a gateway for infrared ray communication and has the function of receiving infrared rays and to proceed with data transmission, as well as isolate dust and miscellaneous particles, and a rain shield to effectively keep out rain to improve the ability of sensing.

2. A light guiding structure using light properties to enhance and centralize the received infrared rays.

3. A fixed support utilizing light properties to extend the effective distance of infrared rays.

4. A back board with a coating of metal material to provide the circuit board with a metal grounding shield to isolate electromagnetic noise and to promote stability.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A structure for an infrared ray communication device placed over a lane of a freeway comprising:

a body having a circuit board socket and a back board inside said body;

a pair of fixed hooks located on an outside rear of said body;

a transformer having a pair of fixed holes and fixed inside said body;

a circuit board fixed in said circuit board socket inside said body;

a fixed support for an emitting module and a light guiding device, said fixed support for said emitting module further comprises a plurality of fixed holes, wherein said fixed support for said emitting module and said light guiding device is fixed on sides of said transformer:

a fixed support for a receiving module, wherein said fixed support for said receiving module is located at an opening of said light guiding device;

an attachment lens whereby said lens is attached to said body; and a rain shield placed outside of said body;

whereby said light guiding device has a quadrilateral trumpet shape to enhance and centralize the received infrared rays.

2. A structure for an infrared ray communication device placed over a lane as recited in claim 1, wherein said back board inside said body is coated with a metallic material.

3. A structure for an infrared ray communication device placed over a lane of a freeway comprising:

a body having a circuit board socket and a back board inside said body;

a pair of fixed hooks located on an outside rear of said body;

a transformer fixed inside said body;

a circuit board fixed in said circuit board socket inside said body;

a fixed support for an emitting module and a light guiding device, wherein said fixed support for said emitting module and said light guiding device is fixed on sides of said transformer;

a fixed support for a receiving module wherein said fixed support for said receiving module is located at an opening of said light guiding device;

an attachment lens whereby said lens is attached to said body; and a rain shield placed outside of said body;

wherein said fixed support of said emitting module further comprises a plane A and a plane B, and an included angle between said plane A and said plane B, whereby said included angle is calculated to extend the effective communication distance of the infrared rays.

4. A structure for an infrared ray communication device placed over a lane as recited in claim 3, wherein said back board inside said body is coated with a metallic material.

* * * * *